US006773309B1

(12) United States Patent
Shuey

(10) Patent No.: US 6,773,309 B1
(45) Date of Patent: Aug. 10, 2004

(54) ELECTRICAL CONNECTOR WITH INTEGRAL CONTACT RETENTION AND TERMINAL POSITION ASSURANCE ELEMENTS

(75) Inventor: John R. Shuey, Mechanicsburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/449,616

(22) Filed: May 30, 2003

(51) Int. Cl.[7] ..... H01R 13/502
(52) U.S. Cl. ..... 439/701
(58) Field of Search ..... 439/701, 595, 439/752, 731, 732, 287

(56) References Cited

U.S. PATENT DOCUMENTS 5,288,250 A * 2/1994 Sumida ..... 439/701
5,890,933 A * 4/1999 Okabe ..... 439/701
5,895,296 A * 4/1999 Okabe ..... 439/701
5,967,842 A * 10/1999 Okabe ..... 439/596
5,997,362 A * 12/1999 Hatagishi et al. ..... 439/701
6,000,971 A * 12/1999 Hatagishi et al. ..... 439/701
6,027,378 A * 2/2000 Abe et al. ..... 439/701
6,045,409 A * 4/2000 Abe ..... 439/701
6,135,824 A * 10/2000 Okabe et al. ..... 439/701
6,336,831 B1 * 1/2002 Abe ..... 439/701
6,402,568 B1 * 6/2002 Nagai ..... 439/701
6,409,551 B1 * 6/2002 Nagai ..... 439/701
6,551,119 B1 * 4/2003 Sakamoto et al. ..... 439/287

OTHER PUBLICATIONS

Multilock Connector, 040/070 Series Hybrid, p. 43, Catalog 65839, Revised 12–98.

* cited by examiner

*Primary Examiner*—Tulsidas C Patel

(57) ABSTRACT

An electrical connector includes an upper block, a lower block, and a terminal position assurance (TPA) element provided with at least one of the upper and lower blocks. The upper block is snappably joined to the lower block along a first direction when aligned in a pre-latched relation with one another. The upper and lower blocks are moveable in a second direction transverse to the first direction from a pre-latched position to a final seated position. The upper block includes a side latch that engages a rib on the lower block when the upper and lower blocks are joined. A shroud on the lower block engages the upper block and a boss at the forward end of the upper block is received in a retention slot on the lower block to inhibit disengagement of the upper block from the lower block when the upper and lower blocks are in the final seated position. The lower block includes a contact cavity that has a terminal retention beam. The terminal retention beam is deflectable from an initial position to a second position, elevated from the initial position to receive an electrical contact. The terminal retention beam returns to the initial position when the contact is fully inserted in the cavity.

20 Claims, 4 Drawing Sheets

ELECTRICAL CONNECTOR WITH INTEGRAL CONTACT RETENTION AND TERMINAL POSITION ASSURANCE ELEMENTS

BACKGROUND OF THE INVENTION

This invention relates generally to electrical connectors and more particularly to a connector with integral terminal position assurance and contact retention members.

A variety of electrical connectors have been proposed that include a dielectric housing having a plurality of terminal-receiving cavities within which are mounted a plurality of terminal contacts. Improper installation or loading of terminal contacts inside a connector housing may create significant problems for an installer or an end user when undiagnosed at the time of assembly.

Terminal position assurance (TPA) elements in connectors are used to secure inserted terminal contacts in respective connector cavities. The TPA element secures the terminal contact in proper position for electrically mating with the terminal contacts of a mating connector or other electrical component. Known TPA elements are typically formed separately from the connector and are secured to the connector only after all of the terminal contacts have been loaded into the connector. Disadvantages associated with such TPA elements include the need to provide multiple parts at an assembly station, the risk of lost or misplaced parts, the added cost associated with the production of separate parts and the like.

A need exists for a connector that provides a terminal position assurance feature and contact retention support feature without the need for separate components to provide each feature.

BRIEF DESCRIPTION OF THE INVENTION

In one embodiment of the invention, an electrical connector includes an upper block, a lower block, and a terminal position assurance (TPA) element provided with at least one of the upper and lower blocks. The upper block is snappably joined to the lower block along a first direction when aligned in a pre-latched relation with one another. The upper and lower blocks are moveable in a second direction transverse to the first direction from a pre-latched position to a final seated position.

In another embodiment of the invention, an electrical connector includes an upper block having a retention ledge on a lower surface thereof, and a lower block joining the upper block. The upper and lower blocks are slidable relative to each other between a pre-latched position and a final seated position. The lower block includes a contact cavity configured to receive an electrical contact. A terminal retention beam is attached to the lower block. The retention beam is biased toward the contact cavity and the upper block engages the retention beam to inhibit removal of an electrical contact from a contact cavity when the upper and lower blocks are in the final seated position.

DETAILED DESCRIPTION OF THE INVENTION

Figure 1:
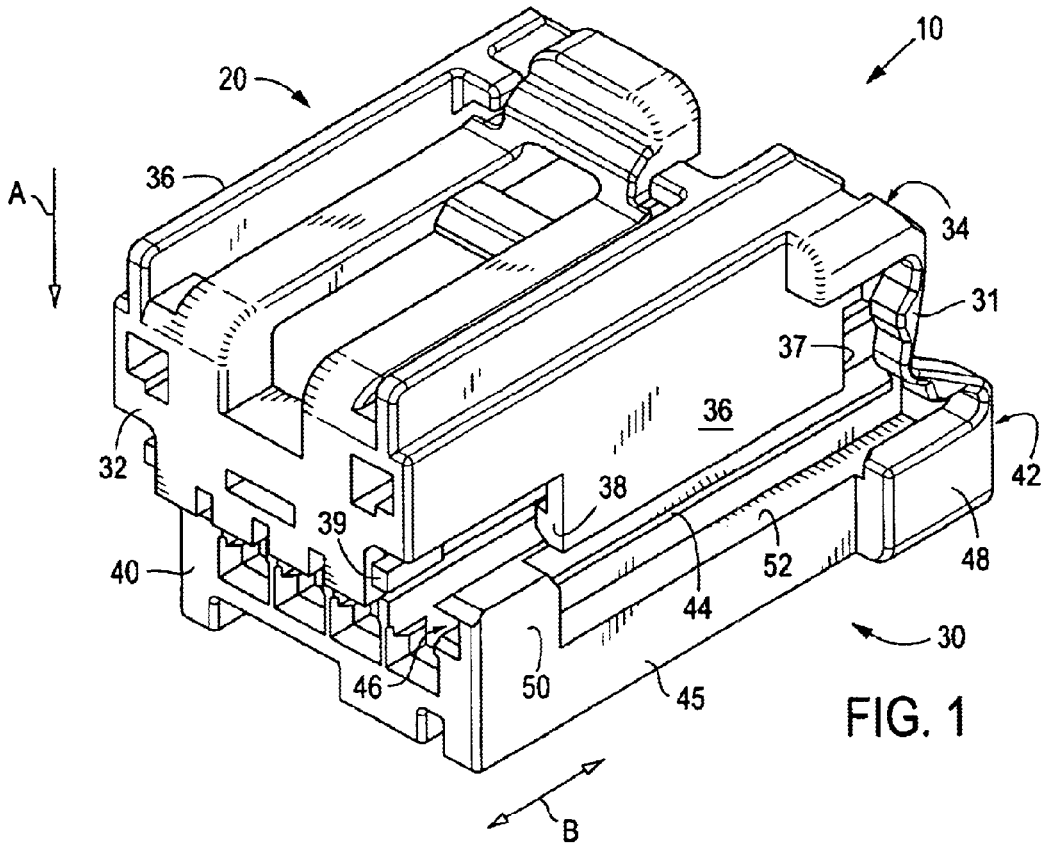
FIG. 1 is a top perspective view of a connector housing as molded and un-joined according to an embodiment of the present invention.
Figure 2:
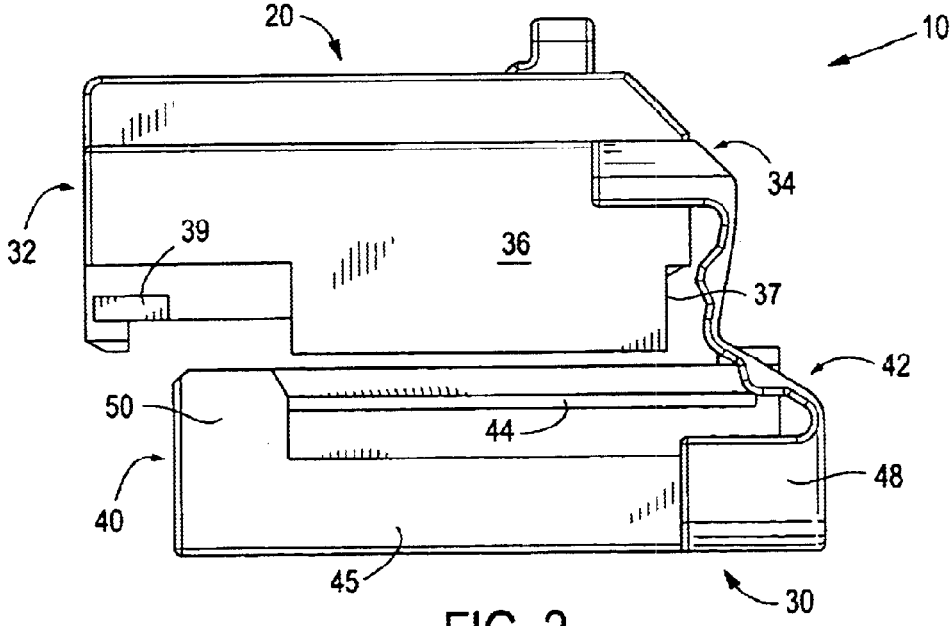
FIG. 2 is a side view of the un-joined connector of FIG. 1.

FIG. 1 is a top perspective view of one embodiment of a connector 10. FIG. 2 is a side view of the connector 10 of FIG. 1. Connector 10 includes an upper block 20 and a lower block 30. As shown in FIGS. 1 and 2, upper block 20 is separate slightly from lower block 30, in an as molded condition. Upper and lower blocks 20 and 30 are integrally connected by a flexible link 31. The upper block 20 includes a front face 32, a rear face 34 and a pair of side panels 36. A side latch 38 extends along a portion of each side panel 36 of upper block 20 (only one side latch 38 is shown). The side latches 38 face one another. Upper block 20 also includes a boss 39 proximate the front face 32.

Lower block 30 includes a front face 40, a rear face 42 and sides 45. A rib 44 extends along a length of each side 45 of lower block 30. The ribs 44 face outward in opposite directions. The ribs 44 are provided in cutout areas above side ledges 52. Lower block 30 also includes at least one retention slot 46 extending from the front face 40 and facing inward. A shroud 48 is positioned on the outside of the side 45 adjacent the rear face 42. The shroud 48 projects upward beyond the side ledge 52. A stop arm 50 extends upwardly from the side 45 proximate the front face 40 of the lower block 30. The retention slot 46 is provided on the interior of the corresponding stop arm 50. The slot 46 receives boss 39. Rib 38 snaps over rib 44 and an end edge 37 of side panel 36 is slid behind shroud 48. The side ledge 52 extends forwardly from the stop are 50 on the lower block 30.

While only discussed in connection with one side, it is understood that either, one or both of side panels 36 and sides 45 may include the features and structure noted herein with respect to FIGS. 1 and 2.

The upper and lower blocks 20 and 30 are snappably joined by pressing the upper block 20 onto the lower block 30 in the assembly direction of arrow A. Once joined, the upper block 20 is movable relative to the lower block 30 along path B (corresponding to seating and unloading directions).

Figure 3:
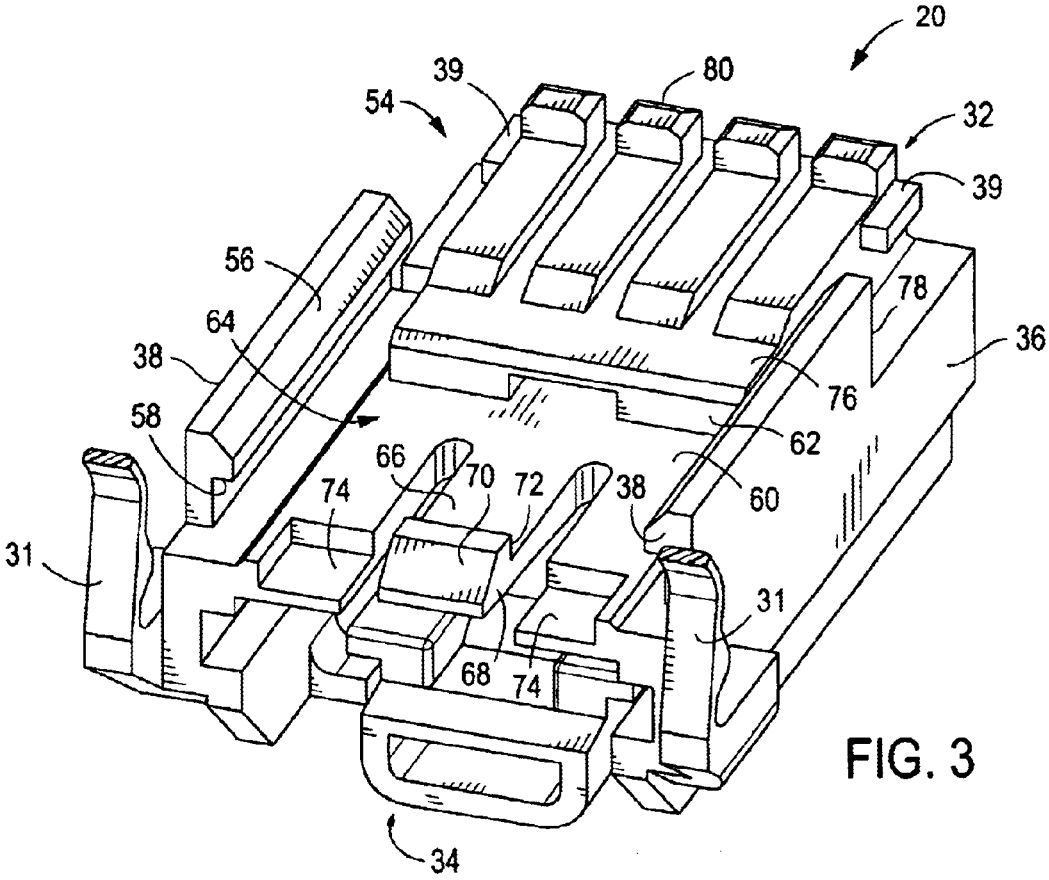
FIG. 3 is a perspective view of the underside of the upper block of the connector housing of FIG. 1.

FIG. 3 illustrates the underside or inner mating face 54 of upper block 20. Each side latch 38 includes a beveled surface 56 that facilitates attachment with the lower block 30 and a locking surface 58 that engages the rib 44 of lower block 30. The locking surface 58 resists removal from rib 44 while permitting a linear sliding motion therebetween. Keeping in mind that the upper block 20 is shown inverted in FIG. 3, the upper block 20 includes a ceiling surface 60 and a stop wall 62. The ceiling surface 60, stop wall 62 and side panels 36 define a space or volume 64 within the upper block 20. A latch beam 66 is centrally positioned on the ceiling surface of upper block 20. The latch beam 66 includes a latch element 68 which extends toward rear face 34. The latch element 68 includes a beveled surface 70 and an engagement face 72. A stop pocket 74 is positioned on each side of the latch beam 66. A retention ledge 76 extends from stop wall 62 toward front face 32. The side panels 36 include a stop edge 78 that, when the upper and lower blocks 20 and 30, respectively, are joined, will engage the stop arm 50 of the lower block 30. The upper block 20 also includes guide blocks 80 proximate the front face 32 and aligned parallel to one another.

Figure 4:
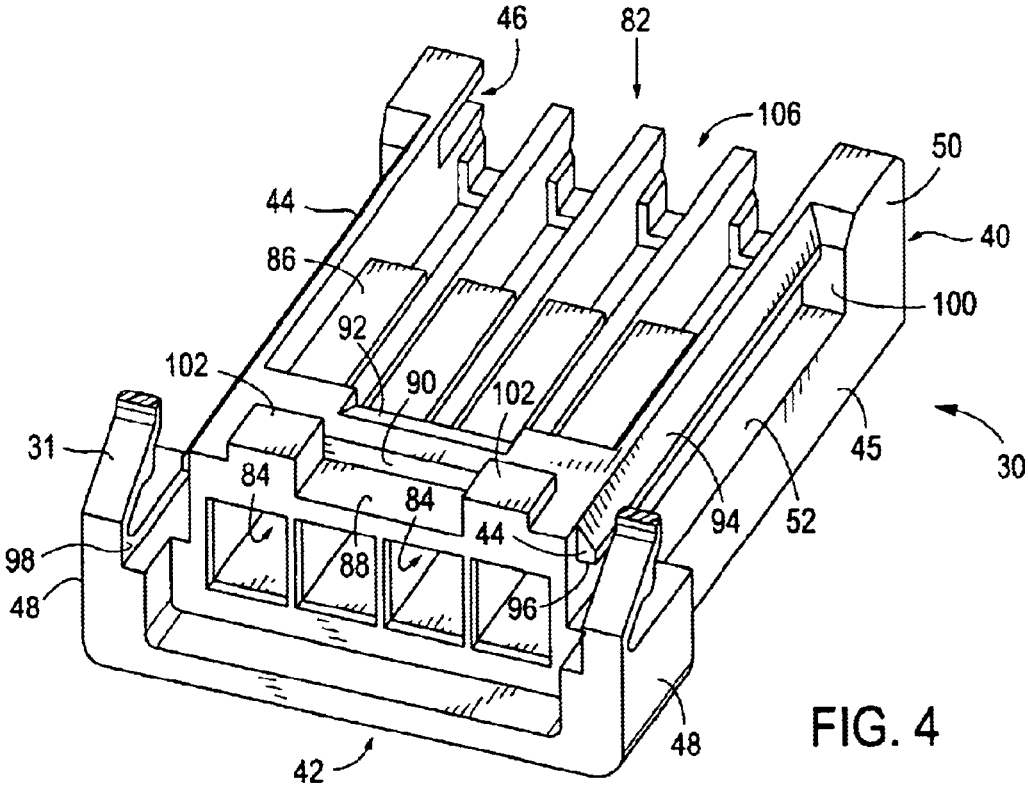
FIG. 4 is a perspective view of the upper surface of the lower block of the connector housing of FIG. 1.

FIG. 4 illustrates the upper surface or inner mating face 82 of lower block 30. From the rear face 42 of lower block 30 extend a plurality of contact cavities 84 opening into lower block 30. At each contact cavity 84 there is a terminal retention beam 86 extending toward the forward end 40 of lower block 30. Lower block 30 also includes a latch pocket 88 that includes a latch engagement surface 90 that is engaged by the latch element 68 of the upper block 20. A beveled surface 92 facilitates engagement with latch element 68. Ribs 44 are shown extending along each side of lower block 30. Each rib 44 has a top bevel 94 that facilitates attachment with the upper block 20 and a locking surface 96 that interlocks with the locking surface 58 of the upper block 20. The shrouds 48 at the rear face 42 of the lower block 30 are shown having a portion 98 extending above side ledges 52. At the front face 40, each stop arm 50 includes a stop edge 100 configured to engage the stop edge 78 on the side panel 36 of the upper block 20. A pair of rearward stopping blocks 102 are positioned at the rear face 42 of the lower block 30 and are configured to engage the stop pockets 74 of the upper block 20. The contact cavities 84 open onto the front face 40 of the lower block 30 through open-sided channels 106 to receive the guide blocks 80 of the upper block 20.

Upper block 20 and lower block 30 of connector 10 are molded as separate units that are only joined by integral flexible link 31. Assembly of the connector 10 is initiated by joining upper block 20 with lower block 30. This is accomplished by aligning the upper and lower blocks 20 and 30, respectively, so that the stop arm 50 of the lower block 30 is positioned between the boss 39 and the stop edge 78 of the upper block 20 and pressing the upper and lower blocks together. When pressed together, the side latch 38 of upper block 20 snaps over the rib 44 of the lower block 30 so that the side latch 38 and rib 44 interlock in a pre-latched position (see FIG. 5). Upper block 20 and lower block 30 are then slidable relative to each other on the side ledge 52 of lower block 30 along path B (FIG. 1).

Figure 5:
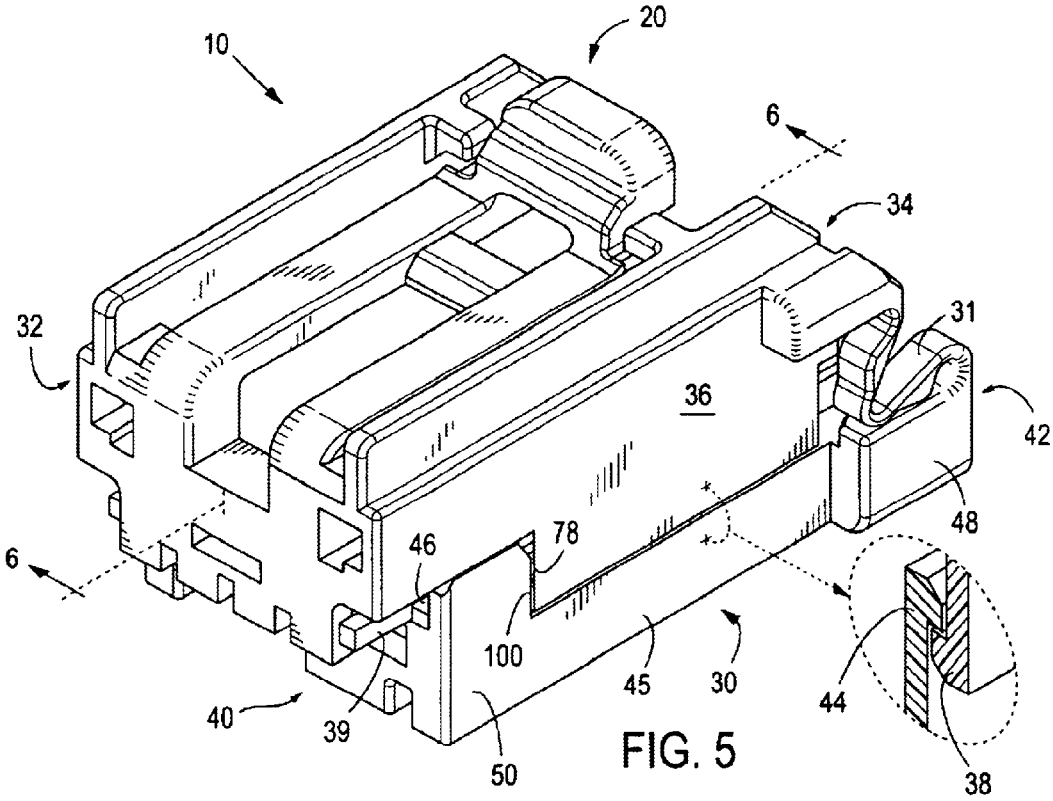
FIG. 5 is a top perspective view of the connector housing of FIG. 1 joined in a pre-latched position.

FIG. 5 illustrates the connector 10 with upper and lower blocks 20 and 30, respectively, joined in a pre-latched position. Note that upper block 20 is inverted from the view shown in FIG. 3 and both upper block 20 and lower block 30 are rotated so that the front faces 32 and 40 are visible. Upper block 20 and lower block 30 are joined by pressing the pieces-together so that the side latch 38 of upper block 20 snaps over the rib 44 of lower block 30 in an interlocking relationship shown in the inset of FIG. 5. In the pre-latch position in FIG. 5, side panel 36 rests upon and is slidable along the side ledge 52 of the lower block 30. In FIG. 5, the upper block 20 is shown in its forward most position with the stop edges 78 and 100 of the side panel 36 and stop arm 50, respectively, engaging each other. The boss 39 of upper block 20 is shown aligned for entry into the retention slot 46 of lower block 30.

Figure 6:
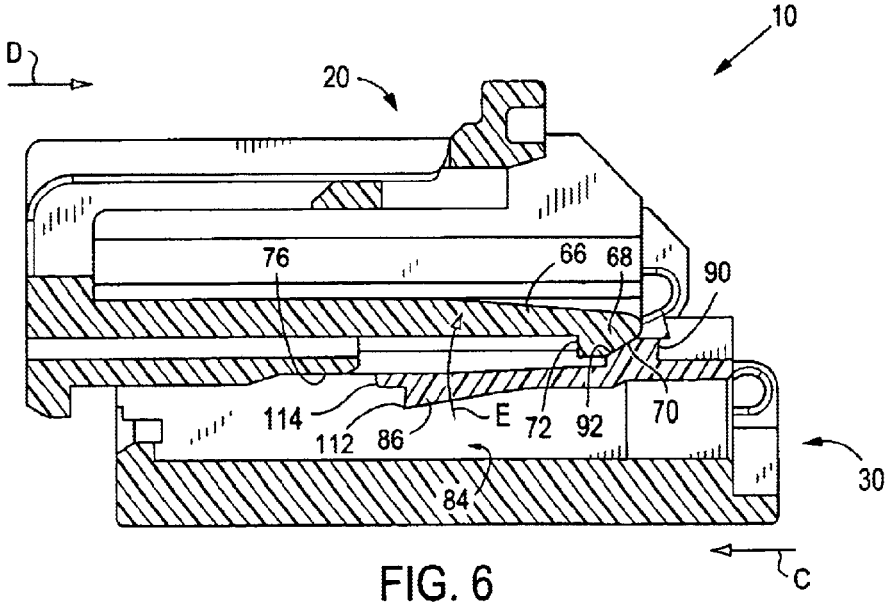
FIG. 6 is a cross sectional view taken through the plane 6—6 of the connector housing of FIG. 5.

FIG. 6 illustrates a cross-sectional view of the connector 10 taken through the plane indicated by 6—6 in FIG. 5. In FIG. 6 the beveled surface 70 of latch element 68 is shown in engagement with the beveled surface 92 at the latch-pocket 88 of lower block 30. The terminal retention beam 86 has a terminal retainer 112 positioned below the forward end 114 of the retention beam 86 which engages a terminal contact (not shown) when inserted into contact cavity 84 in the direction of arrow C. As shown in FIG. 6, the terminal retention beam 86 is positioned to slide underneath retention ledge 76 of upper block 20. As the upper block 20 is moved rearward in the direction of arrow D relative to the lower block 30, the latch element 68 of latch beam 66 will be forced over and into the latch pocket 88 of lower block 30. The latch engagement face 72 of latch element 68 will then engage the latch engagement surface 90 of the lower block 30. The direction of arrow D corresponds to the seating direction which is transverse or perpendicular to the assembly direction of arrow A (FIG. 1).

Figure 7:
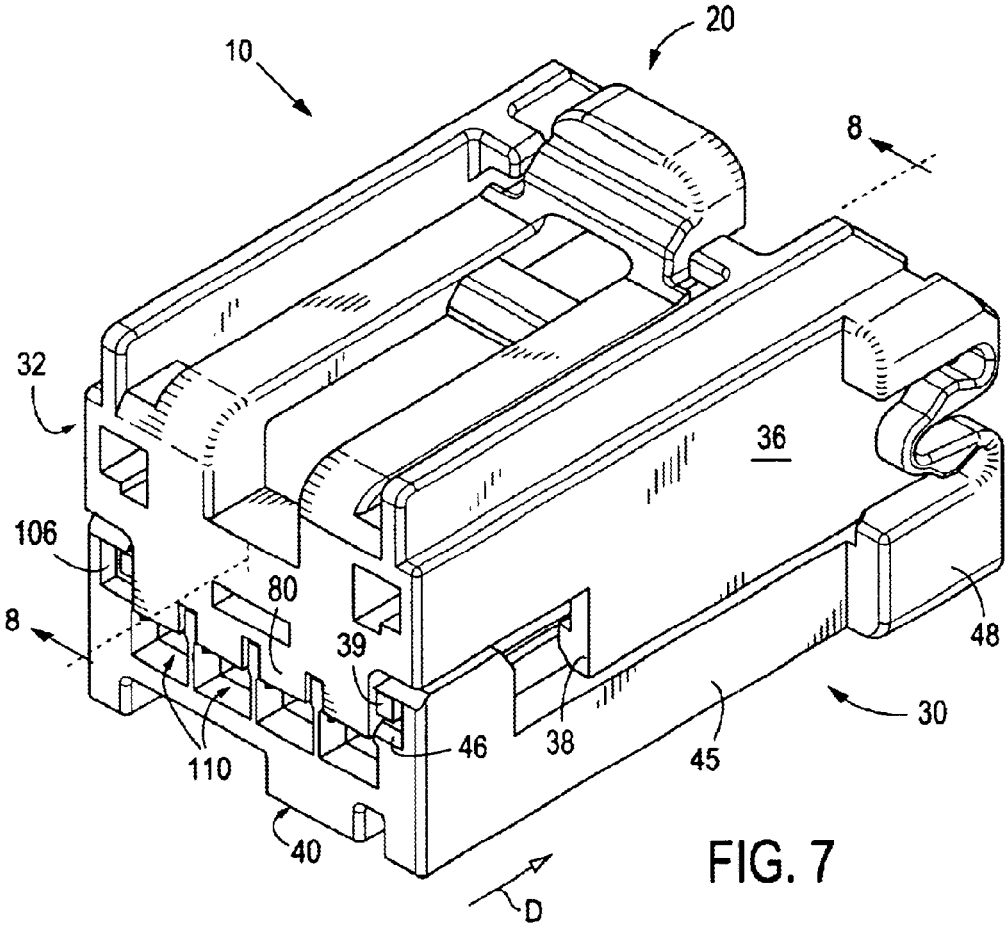
FIG. 7 is a top perspective of the connector housing of FIG. 1 in a final seated position.
Figure 8:
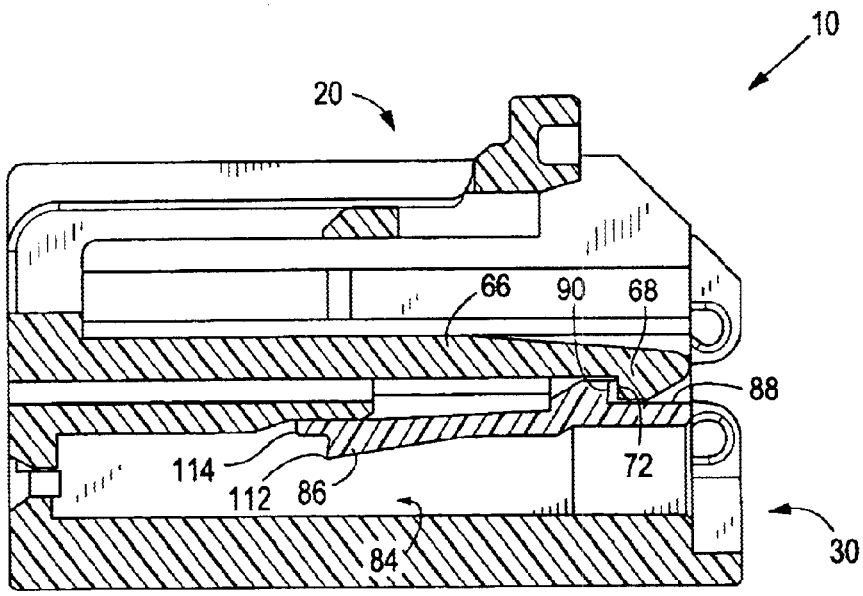
FIG. 8 is a cross sectional view taken through the plane 8—8 of the connector housing of FIG. 7.

FIGS. 7 and 8 illustrate the connector 10 in a final seated position. FIG. 8 represents a cross-section of connector 10 taken through the plane 8—8 of FIG. 7. In FIGS. 7 and 8 upper block 20 has been moved to its rearward most position relative to lower block 30, e.g., in the seating operation. The upper block 20 is moved in a direction transverse to the joining operation. In FIG. 7, the boss 39 of upper block 20 is shown fully received within the retention slot 46 of lower block 30. With the boss 39 fully positioned within the retention slot 46 of lower block 30 separation of the connector 10 is resisted. FIG. 7 also shows the rearward portion of the side latch 38 covered by the extended portion 98 of shroud 48 of lower block 30. The shroud 48 of lower block 30 prevents spreading of side latch 38 to inhibit separation from the rib 44 of lower block 30, so that separation of the upper and lower blocks 20 and 30, respectively, at their rear faces 34 and 42, is also inhibited. Rearward travel of the upper block 20 relative to the lower block 30 is limited by the engagement of the rearward stopping blocks 102 of lower block 30 with the stop pockets 74 on upper block 20. Rearward travel is also limited by the boss 39 reaching the end of the retention slot 46 at the forward end of the lower block 30.

In the final seated position, the guide blocks 80 of upper block 20 are received in the guide block channels 106 of the lower block 30 and the front face 32 of the upper block 20 is aligned substantially with the front face 40 of the lower block 30. The aligned front faces 32 and 40 of the upper and lower blocks 20 and 30, respectively, combine to form a mating face for the connector 10. Terminal contacts from a mating connector can enter connector 10 through the contact openings 110 in the mating face of connector 10.

In FIG. 8, the operation of latch beam 66 and the terminal retention beam 86 of the upper block and lower block 20 and 30, respectively, is illustrated. In the final seated position, the latch beam 66 is moved sufficiently forward that the latch element 68 rests in the latch pocket 88 of lower block 30. As illustrated, the latch engagement face 72 of the latch beam 66 is in engagement with the latch element engagement surface 90 on lower block 30. In addition, the terminal retention beam 86 of lower block 30 is shown engaged with the retention ledge 76 of the upper block 20 such that the terminal retention beam 86 cannot be elevated. When a terminal contact is inserted in the lower block 30 of connector 10 the terminal retainer 112 on the terminal retention beam 86 blocks removal of the contact providing the terminal retention support feature of contact 10. The terminal retention beam 86 is biased toward the contact cavity 84. If a terminal contact is only partially inserted in lower block 20 the terminal retainer 112, and along with it the terminal retention beam 86 is forced upward by the contact. This upward movement of the terminal retention beam 86 will cause the terminal retention beam forward end 114 to impact the stop wall 62 of upper block 20 which prevents the upper block 20 from being moved to the final seated position. Thus, the connector 10 also provides for terminal position assurance.

In operation, upper block 20 and lower block 30 are molded as separate pieces but connected through a flexible link 31 that keeps the parts together that will be required to form a complete connector 10. The upper block 20 and lower block 30 are positioned with upper block 20 above the lower block 30 and aligned in what will become the pre-latched position. The stop arm 50 of the lower block 30 is aligned so that it is between the boss 39 and the stop edge 78 on the side panel 36 of upper block 20. The forward edge of the side panel 36 of upper block 20 is also behind the shroud 48-of the lower block 30. Thus aligned, the upper and lower blocks 20 and 30, respectively, can be pressed together with the side latch 38 of the upper block interlocking over the rib 44 of the lower block 30. Thus joined the connector 10 is in its pre-latched position and is prepared to receive terminal contacts.

Terminal contacts (not shown) are inserted into the lower block 30 through the rearward face 42 via the contact cavity 84 which is best shown in FIG. 4. With reference to FIG. 6, as the terminal contact is inserted it encounters the termninal retainer 112 of the terminal retention beam 86. Further insertion of the terminal contact forces the terminal retention beam 86 upward in the direction of arrow E into the volume 64 of upper block 20. If the terminal retention beam 86 however remains in this space, final seating cannot be achieved. When the terminal retention beam 86 is elevated into the volume 64 of the upper block 20 the stop wall 62 of the upper block 20 will impact the terminal retention beam forward end 114 preventing rearward movement of the upper block 20 to the final seated position. However, as the terminal contact is seated within the lower block 30 the terminal retainer 112 is cleared which allows the terminal retention beam 86 to move down from the path of the stop wall 62 of the upper block 20. Once the terminal retention beam 86 is below the path of travel of the stop wall 62 of the upper block 20, the upper block 20 can be moved to the final seated position. Thus, terminal position assurance is provided and further, the retention ledge 76 of the upper block 20 prevents the upward movement of the terminal retention beam 86 so that the terminal contact cannot be removed from the connector 10. Thus, terminal retention support is also provided.

In the final seated position as illustrated in FIGS. 7 and 8, the assembly of connector 10 is complete and the connector 10 is ready to receive a mating connector. Contact terminals from a mating connector can enter the connector 10 through the contact cavity openings 110 on the mating face of the connector 10. The boss 39 is received in the retention slot 46 of lower block 30 and the rearward end of the side latch 36 is held in place by the shroud 48 of lower block 30 which prevents separation of the side latch 38 of upper block 20 and the rib 44 of lower block 30. The upper and lower blocks 20 and 30, respectively, are thus discouraged from vertical separation. At the same time, when upper block 20 is moved rearwardly to the final seated position, the latch element 68 of the latch beam 66 moves into the latch pocket 88 of the lower beam 30 so that the latch engagement face 72 of the latch element 68 of upper block 20 engages the latch element engagement surface 90 of the lower block 30 to inhibit movement of the upper block 20 out of the final seated position.

The embodiments thus described provide connector having a terminal position assurance feature along with contact retention support in a package requiring no separately inserted components. The connector is well suited for any application not requiring a sealed connector such as vehicle interior or under dash wiring and circuitry.

While the invention has been described in terms of various specific embodiments, those skilled in the art will recognize that the invention can be practiced with modification within the spirit and scope of the claims.

What is claimed is:

1. An electrical connector comprising:

an upper block;

a lower block; and a terminal position assurance (TPA) element provided with at least one of said upper and lower blocks, said upper block being snappably joined to said lower block along a first direction when aligned in a pre-latched relation with one another, said upper and lower blocks being movable in a second direction transverse to said first direction from a pre-latched position to a final seated position.

2. The connector of claim 1 wherein said upper block includes a side latch that slidably engages a corresponding rib on said lower block when said upper block is joined to said lower block.

3. The connector of claim 1 wherein said lower block includes a shroud engaging said upper block to inhibit disengagement of said upper block from said lower block when said upper and lower blocks are in said final seated position.

4. The connector of claim 1 wherein said upper block includes a boss at a forward end thereof, said boss slidably engaging a retention slot on said lower block to hold said upper and lower blocks together when in said final seated position.

5. The connector of claim 1 wherein said lower block includes a contact cavity, said cavity including a terminal retention beam, said terminal retention beam being deflectable from an initial position to a second position elevated from said initial position in order to receive an electrical contact, said retention beam returning to said initial position when the contact is fully inserted in said cavity.

6. The connector of claim 1 wherein said TPA element includes a terminal retention beam configured to engage a step on a lower surface of said upper block and said retention beam is deflected to a position at which said retention beam inhibits movement of said upper block from said pre-latched position to said final seated position when an electrical contact is not fully inserted.

7. The connector of claim 1 wherein said upper block includes a latch beam on a lower surface thereof, said latch beam including a latch element engaging a pocket on an upper surface of said lower block to hold said upper and lower blocks in said final seated position.

8. The connector of claim 1 wherein said upper and lower blocks include a latch and rib extending along a length of said upper and lower blocks parallel to said second direction.

9. The connector of claim 1 further comprising a latch and rib combined with one another when said upper and lower blocks are joined together.

10. The connector of claim 1 further comprising a pair of latches provided on opposite sides of one of said upper and lower blocks, said latches facing one another.

11. The connector of claim 1 further comprising a pair of ribs extending along opposite sides of one of said upper and lower blocks.

12. An electrical connector comprising:

an upper block, including a retention ledge on a lower surface thereof;

a lower block joining said upper block, said upper and lower blocks being slidable relative to each other between a pre-latched position and a final seated position, said lower block including a contact cavity configured to receive an electrical contact; and a terminal retention beam attached to said lower block, said retention beam being biased toward said contact cavity, said upper block engaging said retention beam to inhibit removal of an electrical contact from said contact cavity when said upper and lower blocks are in said final seated position.

13. The connector of claim 12 wherein said terminal retention beam is connected to a rearward portion of said lower block, said terminal retention beam being deflectable from an initial position to a second position elevated from said initial position to receive the contact, said terminal retention beam returning to said initial position when the contact is fully inserted in said cavity.

14. The connector of claim 12 wherein said upper block includes a side latch slidably engaging a corresponding rib provided on said lower block.

15. The connector of claim 12 wherein said lower block includes a shroud partially covering a side latch provided on said upper block to inhibit disengagement of said upper block from said lower block when said upper and lower blocks are in said final seated position.

16. The connector of claim 12 wherein said upper block includes a boss at a forward end thereof, said boss being configured to slidably engage a retention slot on said lower block to hold said upper and lower blocks together when in said final seated position.

17. The connector of claim 12 wherein said upper block includes a latch beam on a lower surface thereof, said latch beam including a latch element at a rearward end thereof configured to engage a pocket on an upper surface of said lower block to hold said upper and lower blocks in said final seated position.

18. The connector of claim 12 wherein said retention beam is deflectable outward from said contact cavity when said upper and lower blocks are in said pre-latched position.

19. The connector of claim 12 wherein said upper block includes a retention ledge movable into an engaging relation with said retention beam when said upper and lower blocks are in said final seated position.

20. The connector of claim 12 wherein said upper block includes an opening, said retention beam being deflected upward into said opening in said upper block when said upper and lower blocks are in said pre-latched position.

* * * * *